US007009571B2

(12) United States Patent
McCandless

(10) Patent No.: US 7,009,571 B2
(45) Date of Patent: Mar. 7, 2006

(54) METHOD AND APPARATUS FOR FORMING SYMMETRICAL ENERGY PATTERNS IN BEAM FORMING ANTENNAS

(75) Inventor: Jay McCandless, Durham, NC (US)

(73) Assignee: BWA Technology, Inc., Las Vegas, NV (US)

( * ) Notice: Subject to any disclaimer, the term of this patent is extended or adjusted under 35 U.S.C. 154(b) by 0 days.

(21) Appl. No.: 10/435,387

(22) Filed: May 12, 2003

(65) Prior Publication Data

US 2004/0227685 A1 Nov. 18, 2004

(51) Int. Cl.
*H01Q 13/10* (2006.01)

(52) U.S. Cl. ..... 343/767; 343/789

(58) Field of Classification Search ..... 343/767–772, 343/786, 789

See application file for complete search history.

(56) References Cited

U.S. PATENT DOCUMENTS

| | | | | |
|---|---|---|---|---|
| 3,757,343 | A * | 9/1973 | Bogner | 343/770 |
| 4,819,004 | A * | 4/1989 | Argintaru et al. | 343/778 |
| 5,202,697 | A * | 4/1993 | Bonebright et al. | 343/770 |
| 6,040,805 | A * | 3/2000 | Huynh et al. | 343/785 |
| 6,597,322 | B1 * | 7/2003 | Takenoshita | 343/771 |

* cited by examiner

*Primary Examiner*—Michael C. Wimer
(74) *Attorney, Agent, or Firm*—Duane Morris LLP

(57) ABSTRACT

A method and apparatus by which electromagnetic wave energy is passed through a beam-forming antenna thereby forming a capacitive surface reactance which eliminates E-plane edge currents on the antenna and balances hybrid electromagnetic energy modes resulting in symmetrical electromagnetic wave patterns.

26 Claims, 3 Drawing Sheets

METHOD AND APPARATUS FOR FORMING SYMMETRICAL ENERGY PATTERNS IN BEAM FORMING ANTENNAS

BACKGROUND

It is well known that the transmission of electromagnetic energy through a waveguide may introduce the propagation of several modes of electromagnetic waves. The physical dimensions of the waveguide determine the dominant mode. For example, the TE10 (transverse electric) mode is the dominant mode in a rectangular waveguide. The TE signifies that all electric fields are transverse to the direction of propagation and that no longitudinal electric field is present. If the frequency of a communicated signal is above the cutoff frequency for a given mode, the electromagnetic energy may be transmitted through the waveguide for that particular mode with minimal attenuation. Therefore, it may be desirable in many instances to avoid operating an electromagnetic wave energy system near the lower cutoff frequency due to a dramatic attenuation at that point.

Known beam-forming antennas do little to filter E-plane edge currents on the beam-forming antenna. Consequently, surface electromagnetic waves may be supported and are propagated with the polarized electromagnetic signal. This may result in unwanted noise or undesirable electromagnetic sector patterns. A need exists for beam-forming antennas to eliminate E-plane edge currents and to minimize the propagation of surface electromagnetic waves. A further need exists to balance hybrid modes of the dominant mode which may result in clearer and more symmetrical electromagnetic wave energy for communications purposes.

It is therefore an object of the disclosed subject matter to present a novel beam-forming antenna that eliminates edge currents and creates an electromagnetic signal with symmetrical radiation patterns.

It is also an object of the disclosed subject matter to present a novel method of filtering electromagnetic wave energy by propagating electromagnetic wave energy to a beam-forming antenna, passing the energy through the beam-forming antenna and forming a capacitive surface reactance so that surface waves cannot be supported on the beam-forming antenna.

DETAILED DESCRIPTION

Figure 1:
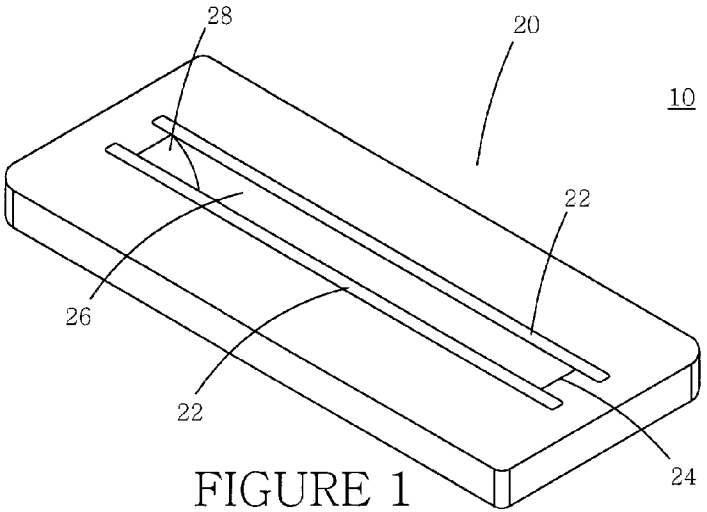
FIG. 1 is an isometric view of the beam-forming antenna showing the forward facing surface.
Figure 2:
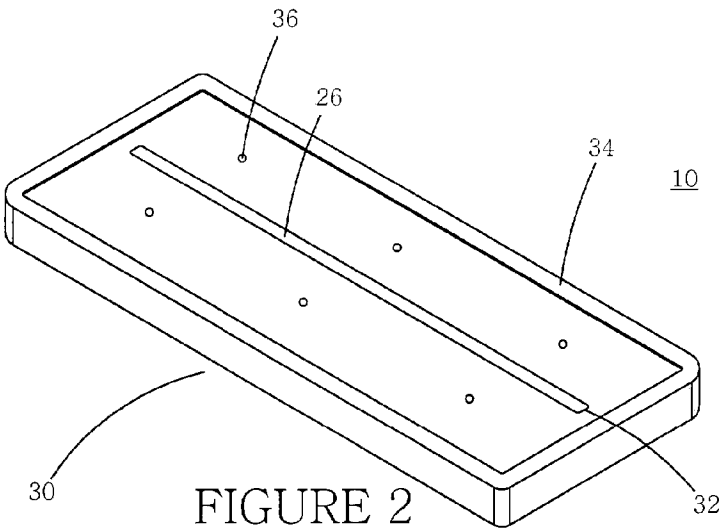
FIG. 2 is an isometric view of the beam-forming antenna showing the reverse facing surface.

The beam-forming antenna herein described operates so as to form a beam with exceptionally good beam patterns over a bandwidth that is more than twice the size of the bandwidth of a beam with acceptable beam patterns capable of being produced with prior art antennas.

With reference to the figures, a beam-forming antenna 10 is illustrated as a plate having a forward facing surface 20 and reverse facing surface 30. The forward surface 20 defines a centrally located, generally rectangular opening 24 to a passage through the plate to a centrally located, generally rectangular opening 32 on the reverse facing surface 30. The forward surface 20 has slots 22 adjacent to each of the elongated sides of the generally rectangular opening 24. The slots 22 are equidistant from the adjacent sides wherein the number and arrangement of the slots 22 act to eliminate E-plane edge currents on the plate thereby creating a capacitive surface reactance when electromagnetic wave energy is passed through the plate. As is known in the art, the forward facing surface of the beam-forming antenna faces the downrange direction and the reverse facing surface faces the source of the electromagnetic wave energy. The slots are essentially cut-off waveguide elements. The polarization-independent properties of the corrugated forward facing surface permits propagation of hybrid TE (transverse electric) and TM (transverse magnetic) modes. When these hybrid modes are balanced, the radiation patterns may become symmetrical.

The forward surface 20 of the beam-forming antenna 10 has a length L with each of the slots 22 having a shorter length of L1. The opening 24 on the forward surface has a length of L2 and the reverse facing opening 32 has a length of L3. Depending upon the desired electromagnetic wave energy properties, the dimensions of the openings in the forward surface and reverse surface may vary in relation to the other. Typically, $L3 \leqq L2$. Preferably, the length of the slots 22, L1, and the length of the opening 24, L2, are related as follows: $L1 > L2 + \lambda$, where $\lambda$ is the wavelength of the maximum frequency of operation of the beam-forming antenna. As is well known in the art, and as used herein, references to the wavelength of either the electromagnetic wave energy or of the maximum frequency of operation of the beam-forming antenna, refer to the wavelength at the center frequency of the electromagnetic wave for which the beam-forming antenna is designed to operate. The length of the opening 24, L2, is a function of the desired beam width of the radiation pattern. As is known in the art, if the beam width is desired to be greater, then the dimension L2 is reduced. For example, if the dimension L2 is approximately equal to about ten wavelengths of the radiated electromagnetic signal, the beam width of the radiated electromagnetic signal is approximately 5 degrees. If the dimension L2 is approximately ½ of the wavelength of the radiated electromagnetic signal, then the beam width of the radiated electromagnetic signal is approximately 180 degrees. Those of skill in the art will understand the relationship between the wavelength of the radiated electromagnetic signal and the length of the opening 24 (i.e., the dimension L2).

The width from one side of the plate as measured to the adjacent elongated side of one slot is W1 and is preferably $>\lambda$, where $\lambda$ is the wavelength of the maximum frequency of operation of the beam-forming antenna. The forward surface 20 may be symmetrical depending upon the desired electromagnetic wave properties. The total width of the antenna is denoted as W and is preferably at least 4 times the wavelength of the maximum frequency of operation of the beam-forming antenna.

Figure 3:
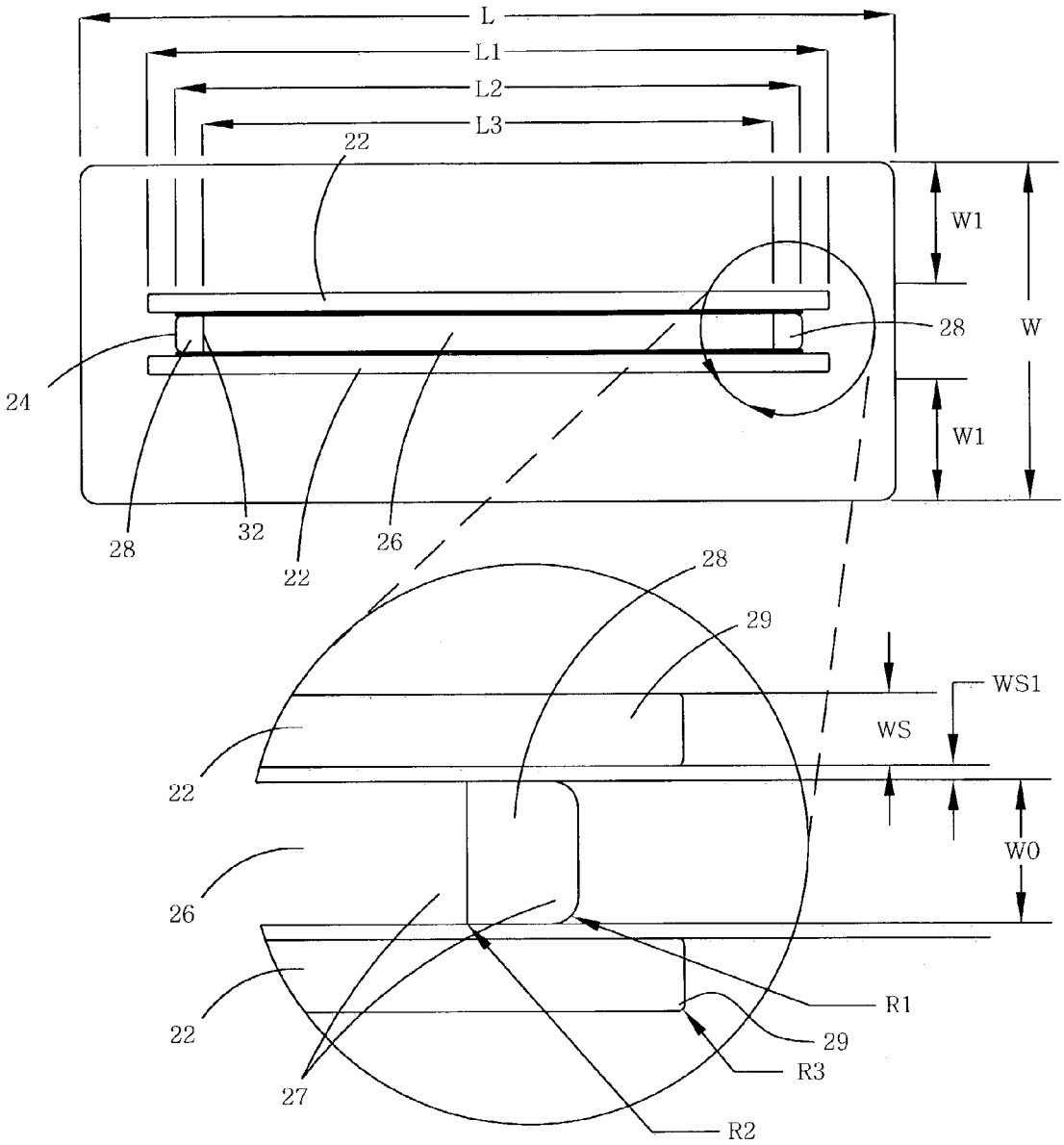
FIG. 3 is a plan view of the beam-forming antenna shown in FIGS. 1 and 2 illustrating the forward facing surface.

Directing attention to FIG. 3, an inset is shown which is a magnification of the relationship between the opening 24 on the forward surface 20 and the slots 22 in the forward surface 20. The total width WS of each slot 22 as measured from one elongated side to its opposing elongated side corresponds to the opposing slot 22 width. The distance WS1 between the adjacent elongated sides of the slot 22 and the opening 24 of the passage 26 on the forward surface 20 may be less than the width of the opening WO. One consideration in determining the dimension WS1 is ease of machining. WS, WS1 and WO may be dependent upon the desired electromagnetic wave properties in the system. Specifically, since the polarization of the signal in passage 26 has the E-field aligned with the length, WO must be greater than ½ the wavelength at the minimum desired frequency of operation. For optimum operation, the slots 22 should have a width WS that cuts off the TE10 mode because the TE10 mode may also have an E-field aligned with the length of the slot 22. Therefore, WS should be less than ½ the wavelength of the maximum frequency of operation. Preferably, the distance from the longitudinal center line of a slot 22 to the closest longitudinal edge of the opening 24 is approximately ½ the wavelength of the maximum frequency of operation of the beam-forming antenna. While a preferred embodiment may contain only one slot 22 disposed on each side of the opening 24, one of skill in the art will understand that the present invention may contain more than one slot 22 disposed on each side of the opening 24.

With attention still directed to FIG. 3, the passage 26 of the beam-forming antenna 10 may be adapted to reduce loss due to reflection. The passage 26 comprises the opening 24 on the forward face 20 and the opening 32 on the reverse face 30. The opening 24 disposed on the forward face 20 may be larger than the opening 32 disposed on the reverse face 30. The opening 32 on the reverse face 30 is preferably the same as or smaller than the opening 24 on the forward face 20. The passage 26 may be formed so that areas 28 on the opposing ends of passage 26, as shown in FIG. 3, are not parallel. The areas 28 may be at an angle other than 90 degrees to the forward face 20. In one embodiment, the angle formed between the areas 28 and the forward face 20 is 45 degrees so that the opening 24 on the forward face 20 is larger than the opening 32 of the reverse face 30. It is to be understood that angles other than 45 degree angles are contemplated by the present disclosure and that the disclosure is not to be interpreted as limited to only 45 degree angles. The areas 28 may be milled into the beam-forming antenna 10 to provide a more subtle change in polarization to the propagated electromagnetic waves. Although being significantly more complicated to manufacture than a beam-forming antenna with a 90 degree angle between the area 28 and the forward face 20, a beam-forming antenna with tapered areas 28 may provide a more subtle transition in polarization. In another embodiment, all the sides of the passage 26 of the beam-forming antenna 10 may be tapered as described above depending upon the desired electromagnetic wave properties in the system.

Figure 4:
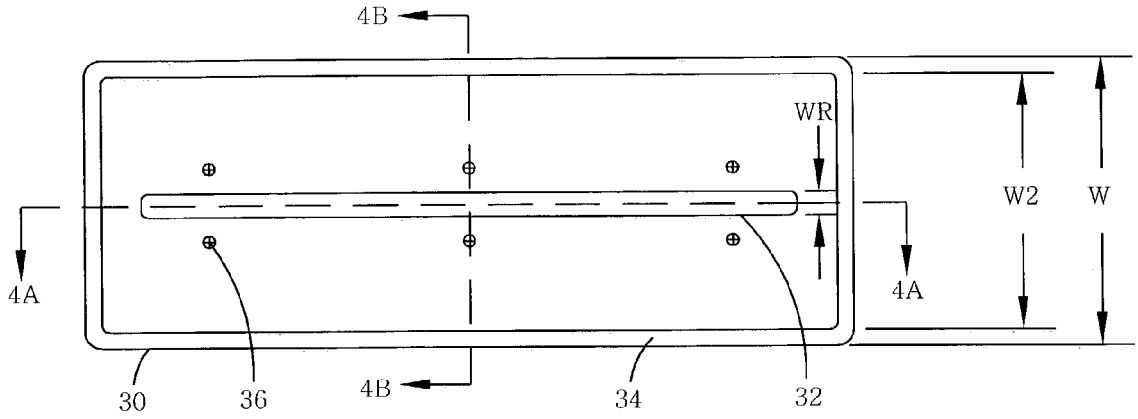
FIG. 4 is a plan view of the beam-forming antenna shown in FIGS. 1 and 2 illustrating the reverse facing surface.

As shown in FIG. 4, the width WR of the reverse surface opening 32 may vary depending upon the desired electromagnetic wave energy properties in the system. The dimensions of the openings on the forward surface 20 and on the reverse surface 30 may vary in relation to the other. Cavities 36 are shown in the substantially planar portion of the reverse surface 30 of the beam-forming antenna 10 wherein the cavities 36 may be used for mounting the beam-forming antenna 10 to desired devices or components. The cavities have no appreciable affect on the desired operation of the present invention. A ridge 34 may also exist on the reverse surface 30 around the outer portion of the beam-forming antenna 10 wherein ridge 34 may be used for mounting a radome (not shown for clarity reasons) or other such device. As illustrated in FIGS. 3 and 4, the total width W of the antenna is measured between the elongated outer edges of the ridge 34 on the reverse face 30. The inner edge of the ridge 34 on the reverse face 30 has a width W2.

Figure 4A:
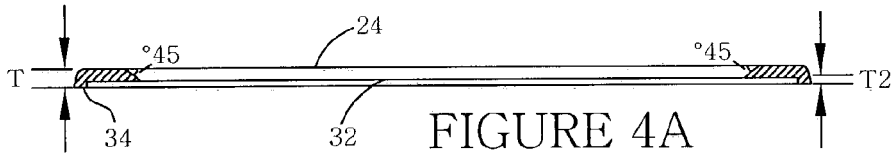
FIG. 4A is a cross-section taken through line 4A—4A of the beam-forming antenna of FIG. 4.

Directing attention to FIG. 4A, a longitudinal cross-section along line 4A—4A of the beam-forming antenna 10 is illustrated. The forward surface opening 24 may be offset from the reverse surface opening 32 by a 45 degree angle as measured from the plane of the forward surface 20. The dimensions of the passage 26 and openings in the beam-forming antenna may also vary with the desired properties of the polarized electromagnetic wave energy.

Figure 4B:
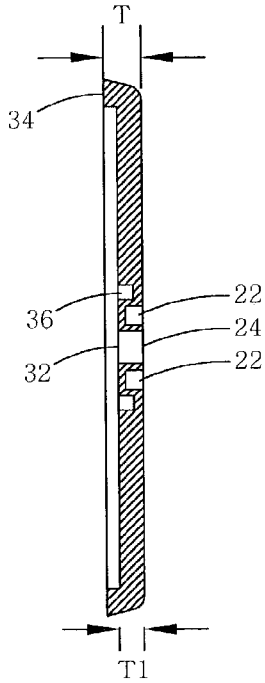
FIG. 4B is a cross-section taken through line 4B—4B of the beam-forming antenna of FIG. 4.

Directing attention to FIG. 4B, a cross-section of the beam-forming antenna 10 is shown that illustrates the thickness T of the device. The depth T1 of the slots 22 in the forward surface 20 may be frequency dependent. Through the addition of the slots 22, the beam-forming antenna is adaptable to create a capacitive surface reactance when electromagnetic wave energy is passed through the beam-forming antenna 10 which may eliminate E-plane edge currents on the forward face of the antenna. Depending upon the desired wavelength of the electromagnetic wave energy utilized in the system, these slots 22 may be made deep enough so that the surface reactance is capacitive; therefore, surface waves may be minimized. Typically, the depth T1 of the slots 22 is approximately ½ the wavelength of the maximum frequency of operation of the beam-forming antenna.

As described above, the beam-forming antenna 10 may provide a system with a desired electromagnetic wave polarization. Furthermore, the beam-forming antenna 10, through the coupling of the antenna to a propagation means, may be further adapted to provide impedance matching or other desired electromagnetic signal path characteristics. These characteristics may also encompass presenting a waveguide of a different size or shape to filter particular frequencies otherwise present in the propagated signal, including an apparatus to adjust the impedance of the waveguide or including an apparatus such as a twist radome to adjust the linear polarization of the antenna. Alternatively, the aforementioned waveguide portion may be omitted and a beam-forming antenna may be coupled directly to a transceiver or other equipment if desired.

In a preferred embodiment, the beam forming antenna is dimensioned for a 27 GHz wave, which has a wavelength of approximately 0.437 inches. For a 27 GHz wave, the following approximate dimensions are preferred:

| FEATURE | DIMENSION (inches) |
|---|---|
| width of opening 24 (WO) | 0.34 |
| width of slots 22 (WS) | ≦0.20 |
| positioning of slots 22 from opening 24 (WS1 + WS/2) | <0.20 |
| depth of slots 22 (T1) | 0.23 |
| width from outer longitudinal edge of slot 22 to nearest longitudinal edge of beam-forming antenna (W1) | >0.437 |
| overall width of beam-forming antenna (W) | 1.75 |
| length of opening 24 (L2) for approx. 5° beam width | 7.45 |

-continued

| FEATURE | DIMENSION (inches) |
|---|---|
| length of opening 24 (L2) for approx. 180° beam width | 0.22 |
| length of slots 24 (L1) | >7.89 |

The preferred embodiment described immediately above shall not be construed to limit the present inventive system or method in any way. It shall be appreciated by those of skill in the art that the relationships described in the preceding paragraphs and the various Figures for the dimensions of the beam-forming antenna with respect to the wavelength of the electromagnetic waves being transmitted apply to a wide spectrum of electromagnetic wavelengths.

It shall be appreciated that, although the beam-forming antenna is described with reference to a transceiver unit and a waveguide, the adaptation of signal paths for accommodating polarization according to the described antenna is not limited to signal paths associated with any particular portion of an electromagnetic wave energy system.

Although the description given above has been presented without any respect to a specific resultant polarization, the beam-forming antenna may be utilized to create various polarizations including, but not limited to, vertical, horizontal, or slant polarizations for a system depending upon the orientation of the antenna within the system or depending upon the addition of an apparatus such as a twist radome downstream of the beam-forming antenna.

While preferred embodiments of the present antenna have been described, it is to be understood that the embodiments described are illustrative only and that the scope of the invention is to be defined solely by the appended claims when accorded a full range of equivalence, many variations and modifications naturally occurring to those of skill in the art from a perusal thereof.

I claim:

1. An antenna comprising:

a plate having forward facing and reverse facing flat surfaces;

each of said surfaces defining a centrally located generally rectangular opening forming a passage through said plate, said passage having substantially constant dimensions;

said forward facing surface having a slot adjacent to each elongated side of said generally rectangular opening; and said slots being disposed an equal distance from said rectangular opening, whereby a capacitive surface reactance is formed when electromagnetic wave energy is passed through said passage.

2. The antenna of claim 1, wherein the cross-sectional area of said passage is reduced from said forward surface to said reverse surface.

3. The antenna of claim 2, wherein said passage tapers from the forward surface to the reverse surface at approximately a 45 degree angle, said angle measured from the plane of the forward surface.

4. The antenna of claim 1, wherein said reverse facing flat surface has at least one cavity.

5. The antenna of claim 1, wherein said reverse facing flat surface has a circumferential ridge.

6. The antenna of claim 1, wherein the length of said plate is greater than the length of said slots.

7. The antenna of claim 1, wherein the length of said slots is greater than the length of said generally rectangular opening in said forward facing flat surface.

8. The antenna of claim 1, wherein the passage has a uniform cross-section from said forward surface to said reverse surface.

9. The antenna of claim 1 wherein said electromagnetic wave energy has a predetermined wavelength.

10. The antenna of claim 9 wherein the width of said generally rectangular opening is approximately equal to three-quarters of said wavelength.

11. The antenna of claim 9 wherein the width of said slots is less than or equal to one-half of said wavelength.

12. The antenna of claim 9 wherein the depth of said slots is approximately equal to one-half of said wavelength.

13. The antenna of claim 9 wherein each slot is spaced apart from the generally rectangular opening a predetermined distance.

14. The antenna of claim 13 wherein the longitudinal centerline of said slots is disposed approximately one-half of said wavelength from the respective nearest elongated side of said generally rectangular opening.

15. The antenna of claim 9 wherein for each of said slots the distance between the distal edge of said slot and the respective nearest edge of said forward facing flat surface is equal to at least one of said wavelength.

16. The antenna of claim 9 wherein the length of each of said slots is greater than the length of said generally rectangular opening by at least one wavelength.

17. The antenna of claim 9 wherein said predetermined wavelength is approximately 0.437 inches.

18. The antenna of claim 9 wherein said predetermined wavelength is in the range of 0.393 to 0.590 inches, inclusive.

19. The antenna of claim 9 wherein said predetermined wavelength is in the range of 0.197 to 1.18 inches, inclusive.

20. An antenna for radiating an electromagnetic signal with a symmetrical radiation pattern at a predetermined wavelength and at a predetermined beamwidth, comprising:

a plate having forward facing and reverse facing flat surfaces wherein said plate defines a centrally located, generally rectangular opening forming a passage having substantially constant dimensions though said plate wherein said opening has:

a width that is a function of said wavelength, and a length that is a function of said beamwidth;

and, said forward facing surface having a slot adjacent to but spaced apart from each elongated side of said opening, wherein each of said slots has:

a width that is a function of said wavelength, a length that is a function of at least said beamwidth, a depth that is a function of said wavelength, and, a spacing apart from said opening that is a function of said wavelength, whereby a capacitive surface reactance is formed when electromagnetic wave energy is passed through said opening to thereby radiate an electromagnetic signal with a symmetrical radiation pattern.

21. The antenna of claim 20 wherein said predetermined wavelength is approximately 0.437 inches.

22. The antenna of claim 20 wherein said predetermined wavelength is in the range of 0.393 to 0.590 inches, inclusive.

23. The antenna of claim 20 wherein said predetermined wavelength is in the range of 0.197 to 1.18 inches, inclusive.

24. The antenna of claim 20 wherein said predetermined beamwidth is approximately 5 degrees.

25. The antenna of claim 20 wherein said predetermined beamwidth is in the range of 2–90 degrees, inclusive.

26. The antenna of claim 20 wherein said predetermined beamwidth is less than or equal to 180 degrees.

* * * * *